US005710478A

United States Patent [19]

Kanemaru et al.

[11] Patent Number: 5,710,478

[45] Date of Patent: Jan. 20, 1998

[54] FIELD EMITTER HAVING SOURCE, CHANNEL, AND DRAIN LAYERS

[75] Inventors: Seigo Kanemaru; Junji Itoh, both of Tsukuba, Japan

[73] Assignee: Agency of Industrial Science & Technology, Ministry of International Trade & Industry, Tokyo, Japan

[21] Appl. No.: 698,260

[22] Filed: Aug. 14, 1996

[30] Foreign Application Priority Data

Aug. 25, 1995 [JP] Japan ..... 7-217107

[51] Int. Cl.[6] ..... H01J 1/30; H01J 19/24

[52] U.S. Cl. ..... 313/336; 313/309; 257/10

[58] Field of Search ..... 315/349, 169.1, 315/169.4; 313/309, 336, 351, 346 R, 367; 257/10

[56] References Cited

U.S. PATENT DOCUMENTS 5,138,237 8/1992 Kane et al. ..... 315/349
5,212,426 5/1993 Kane ..... 315/169.1
5,341,063 8/1994 Kumar ..... 313/309
5,430,348 7/1995 Kane et al. ..... 313/309
5,550,435 8/1996 Kuriyama et al. ..... 315/169.1

*Primary Examiner*—Brian Zimmerman
*Assistant Examiner*—Michael Day
*Attorney, Agent, or Firm*—Oblon, Spivak, McClelland, Maier & Neustadt, P.C.

[57] ABSTRACT

A field emission device of simple structure enables stabilization and control of field emission current. A three-dimensional emitter formed on a base member incorporates therein a source layer on the side in contact with the base member, a drain layer on the side of the distal end including a tip and a channel region layer between the source layer and the drain layer. A gate is formed near the emitter. A strong electric field generated by applying a voltage to the gate causes cold electrons to be emitted from the emitter tip and the voltage applied to the gate also controls the conductivity of the channel region layer, whereby the field emission current emitted from the tip of the emitter is stabilized and controlled.

17 Claims, 6 Drawing Sheets

FIELD EMITTER HAVING SOURCE, CHANNEL, AND DRAIN LAYERS

BACKGROUND OF THE INVENTION

1. Field of the Invention

This invention relates to a field emission device particularly suitable for use as an electron source or electron gun in various types of electron beam utilizing equipment such as flat panel display (FPD) type image display devices, optical printers and electron beam exposure devices as well as in unsophisticated applications such as lamps and other such ultra-small light sources.

2. Description of the Prior Art

In a cathode ray tube or the like, thermoelectron emission is achieved by supplying the tube cathode with a large amount of heat energy. In contrast to this, the field emission device, a focus of intense research in recent years, achieves cold electron emission from the surface of a conductive material such as metal or semiconductor by applying a strong electric field of $10^6$–$10^7$ V/cm to the surface of the material. Wide utilization of this type of device would eliminate the need for CRTs and other devices that consume very large amounts of electric power. Since the device can be fabricated to very small dimensions, moreover, the circuit devices utilizing it would also enjoy greatly reduced power consumption, markedly smaller (thinner) case size, and lower weight.

FIGS. 6(A) and 6(B) show typical structures adopted in prior-art field emission devices. The field emission device 10 shown in FIG. 6(A) has a base member 11 serving as a physical support member for the field emission device 10 as a whole, a conical (typically circular conical) emitter 13 formed on the base member 11, and a gate 14 supported above the base member 11 by an insulating layer 12. The gate 14 is an electrode layer formed of conductive material and is used to apply extraction potential for promoting field emission. In the illustrated case, the gate 14 has an aperture 15 and the distal end of the emitter 13, namely the apex portion $P_O$ in the case of an emitter 13 of circular conical shape, faces into the aperture 15. When the gate 14 is applied with a voltage of not less than a prescribe value (called gate voltage Vg), an electric field of sufficient strength to extract electrons from the emitter 13 is produced between edge of the aperture 15 and the tip $P_O$ of the emitter 13. The gate 14 is generally positioned a little higher than the tip $P_O$ of the emitter 13. If the conical tip $P_O$ of the emitter 13 is processed to a sharp point so that its apex is substantially a point, the electric field produced by the gate voltage Vg applied between the emitter 13 and the gate 14 efficiently concentrates at the pointed tip $P_O$. As a result, the desired field emission can be generated even at a relatively low applied voltage.

This has recently led to attempts to constitute the emitter 13 of semiconductor. For example, K. Betsui reports in Technical Digest 4th Int. Vacuum Microelectronics Conference, Nagahama, 1991, p.26 (Reference 1) that conical emitters of considerable sharpness were successfully obtained by applying sharpening technology combining plasma etching and thermal oxidation to n-type single crystal silicon. Since the emitters produced large emission current at relatively low voltages and could be fabricated with high structural reproducibility, this is expected to become a mainstream emitter fabrication method of the future.

Another type of field emission device 10 does not use a conical emitter but, as shown in FIG. 6(B), a disk-shaped emitter 13 provided at the upper end of a column 18 and having a flat (upper) surface 16 and a peripheral surface 17. The electric field produced by the emitter 13 of this configuration upon the application of the extraction voltage (gate voltage) Vg between the emitter 13 and the gate 14 concentrates at the edge $P_E$ where the flat surface 16 intersects with the columnar peripheral surface 17.

Various other proposals have also been made regarding the shape of the emitter 13 and its positional relationship with respect to the gate 14, and the technique described in Reference 1 is only one among many attempted for the purpose of obtaining a large field emission current at a low voltage. However, the field emission devices developed up to now have a drawback of another kind. This is that the field emission current fluctuates markedly, sometimes diminishing and sometimes rising several times in value. In fact, the field emission current may become so great that the field emission device destroys itself. The main cause of the fluctuation is thought to be large spatial and temporal variation in the work function of the emitter tip owing to adsorption of residual gas in the operating environment and/or contamination etc. during the fabrication process.

To overcome this problem, it is necessary either to completely stabilize the work function of the emitter tip or to actively control the emission current. Although the former method is difficult to implement, interesting proposals regarding the latter method were recently published by A. Ting et al. in Technical Digest 4th Int. Vacuum Microelectronics Conference, Nagahama, 1991, p.200 (Reference 2) and by K. Yokoo et al. in Technical Digest 7th Int. Vacuum Microelectronics Conference, Grenoble, France, 1994, P.58 (Reference 3).

The method will be explained with reference to FIGS. 7(A) and 7(B), in which components corresponding to those in FIGS. 6(A) and 6(B) are assigned the same reference symbols as those in FIGS. 6(A) and 6(B). As shown in FIG. 7(B), the method attempts to control the emission current from the emitter 13 by controlling the drain current of a field effect transistor (FET) 20 connected in series with the field emission device 10. The drain current of the FET is fundamentally controlled by the gate voltage of the FET (the FET 20 gate voltage is designated as Vc in this specification to distinguish it from the gate voltage Vg applied to the gate 14 of the field emission device). From this it follows that the emission current from the emitter 13 of the field emission device 10 can be fundamentally controlled and stabilized by the gate voltage Vc applied to the FET 20.

Notwithstanding, a satisfactory device structure for implementing this principle is not yet available. Consider, for example, the configuration shown in FIG. 7(A), which was reported in connection with the foregoing method. Here, the base member 11 is constituted of semiconductor and an n-type source region 21 and an n-type drain region 22 spaced therefrom are formed on the surface portion of the base member 11 to define the region between them as a channel region 23. A gate insulating layer 24 is formed on the channel region 23 and the gate 25 of the FET is formed on the gate insulating layer 24. While this is substantially the basic structure of an ordinary FET, a certain amount of innovation can be noted at the position where the emitter 13 of the field emission device 10 is provided. Specifically, the emitter 13 is built on the surface of the drain region 22 and the gate 14 of the field emission device 10 is formed on a continuation thereof via the insulating layer 12 also serving as a field insulating layer, whereby the FET 20 and the field emission device 10 are integrated laterally into a unitary device, so to speak.

Therefore, after the source region 21 has been set at ground potential E, for example, and the gate voltage Vg for extracting electrons has been applied to the gate 14 of the field emission device 10, if the gate voltage Vc is applied to the gate 25 at a level matched to the magnitude of the desired field emission current, then the magnitude of the electron current emitted into space from the emitter 13 of the field emission device 10 will be controlled to the desired value. The reference numerals 21, 22 and 25 in FIG. 7(B) correspond to the same regions as the regions of the FET 20 designated by the same reference numerals in FIG. 7(A). A structure of this type can also be seen in U.S. Pat. No. 5,359,256, which includes disclosures not only regarding use of a MOSFET but also regarding use of a JFET, MESFET or the like.

From the operating principle and equivalent circuit shown in FIG. 7(B), it is clear that the emission current can be actively controlled with high precision. Generally, however, a large number of field emission devices 10 of this type have to be densely integrated on a single base member. From this point of view, the principle illustrated in FIG. 7(B), which is valid in itself, should preferably not be implemented by adopting the device circuitry of FIG. 7(A) or the structure disclosed in U.S. Pat. No. 5,359,256 mentioned above. The area required for forming the FET 20 is proportional to the area required for forming the emitter 13 and generally becomes fairly large. The result is a field emission device 10 of quite low packing density and large spacing between adjacent devices. Since the emitter 13 is built completely separately from the FET 20, moreover, the fabrication process becomes highly complex, with a resultant decrease in yield.

This invention was accomplished to overcome the foregoing problems and has as an object to provide a field emission device which, while controlling field emission current from the emitter of a FET according to the principle illustrated in FIG. 7(B), is of a structure essentially avoiding a major increase in size and decrease in packing density per unit field emission device.

SUMMARY OF THE INVENTION

For achieving this object, the invention provides a structural improvement on the prior-art field emission device, which has a three-dimensional emitter extending from a base fixed on a base member serving as a support member to a distal free end and emits cold electrons from the distal end of the emitter under application of an electric field produced by applying a voltage to an extractor gate provided near the distal end of the emitter, the improvement comprising a structure wherein the source, drain and channel regions are built into the emitter.

Specifically, an n-type semiconductor source layer is provided on the base side of the emitter, an n-type semiconductor drain layer is provided on the side of the distal end for emitting cold electrons, a channel region layer is provided between the source layer and the drain layer for controlling the amount of current passage in dependence on the applied electric field, and the electric field generated by the voltage applied to the extractor gate is also used as an electric field with respect to the channel region layer for controlling the amount of current passage (and, as a result, the amount of field emission current).

Since this arrangement allows the emitter to have the same external configuration as that of the conventional field emission device, the invention can, if desired, optionally adopt any of the previously proposed emitter shapes or previously proposed positional relationships between the emitter and the extractor gate. Thus, in one of its relatively basic aspects, the invention provides a field emission device wherein the extractor gate is a conductive electrode layer provided above the base member as supported by an insulating layer and the distal end of the emitter faces into an aperture formed in the conductive electrode layer. In this case, as also seen in the prior-art device shown in FIG. 6(A), the emitter can have the three-dimensional shape of a cone rising from its base to a pointed distal end (but is not limited to conical shape and may instead have the shape of a pyramid, wedge or polygonal cone) and be adapted to emit cold electrons from the apex region (defined as including the apex) of the cone.

Even when the emitter is of ordinary conical shape, the extractor gate can be given a somewhat special configuration. For example, the extractor gate can be constituted as a conductive electrode layer formed along the surface of the conical emitter configuration as separated therefrom by an insulating layer.

The emitter does not have to be conical; the invention can also be applied to a plate-shaped emitter. In this case, the base member includes a flat surface portion and a protruding portion rising from the flat surface portion, the emitter has the three-dimensional shape of a plate extending from its base fixed on the protruding portion of the base member toward its distal free end in a direction parallel or nearly in parallel with the flat surface portion of the base member and emits cold electrons mainly from corners of the plate at the distal end of the emitter. In this configuration, if the base member is made of an insulating material, the extractor gate can be provided directly on the flat surface portion thereof.

In another aspect, the invention provides a field emission device wherein the source, drain and channel of a field effect transistor are built into the aforesaid emitter, a second gate is provided separately of the extractor gate, and the electric field generated by applying a voltage to the second gate controls the amount of current passage in the channel region layer. In this case, the second gate is preferably provided closer to the channel region layer than is the extractor gate so that the channel region layer is not much affected, or almost totally unaffected, by the extractor gate, thereby enabling the amount of current passage of the channel region layer to be controlled by the voltage applied to the second gate (by the electric field generated owing to the applied voltage).

Conversely, if desired it is also possible to adopted a configuration in which the electric field generated by the voltage applied to the second gate acts on the distal end of the emitter and contributes to the emission of cold electrons. In this case, the emission of cold electrons from the emitter can be realized at a lower voltage than in the past. This reduction of driving power is advantageous in that it enables use of smaller and simpler peripheral drive circuitry.

The different modifications applicable to the basic aspect of the invention described earlier can also be applied when the second gate is utilized. For example, it is possible to adopt the configuration in which the extractor gate is constituted as a conductive electrode layer provided on an insulating layer formed on the surface of the base member and the distal end of the emitter faces into an aperture formed in the conductive electrode layer or the configuration in which the three-dimensional shape of the emitter is conical and the conductive electrode layer is formed along the surface of the conical emitter configuration as separated therefrom by an insulating layer.

When, as described earlier, the emitter has the three-dimensional shape of a plate having its base fixed to a protruding portion of the base member and extending toward the distal end in parallel or nearly in parallel with the flat surface portion of the base member, the second gate can be formed on the upper surface of the plate-like emitter as separated therefrom by an insulating layer. If the base member is made of an insulating material, the extractor gate can be provided directly on the flat surface portion thereof.

While in all of the foregoing aspects of the invention the channel region layer is ordinarily formed of p-type semiconductor, it can instead be formed of i-type semiconductor. Since the energy barrier between an i-type semiconductor and an n-type semiconductor is smaller than that between a p-type semiconductor and an n-type semiconductor, use of an i-type semiconductor can be expected to increase the leakage current between the source and drain in the off state when no electric field is being applied. This is not a fatal defect, however, as regards use in this invention. As regards the points of inducing a channel and controlling the conductivity of the channel by an electric field, the situation can be considered to be the same as in the case of using p-type semiconductor. In the special case of using the invention device in a very low temperature environment that causes freeze-out of the carriers in the semiconductor, the i-type semiconductor can be considered to provide the same level of insulation as the insulating portions outside the channel portion. Leakage current is therefore well suppressed.

Notwithstanding, it is generally preferable for both the source layer and the drain layer of the emitter to be formed of high-concentration n-type ($n^+$) semiconductor with high conductivity and for the channel region layer to be formed of low-concentration p-type ($p^-$) semiconductor with somewhat low conductivity. While the operating principle of the invention enables the three-dimensional emitter to be formed of any type of semiconductor, it is most preferably formed of amorphous silicon, polycrystalline silicon or single crystal silicon. When the base member is formed of n-type semiconductor, the source layer of the emitter is of the same conductivity type and can therefore be formed integrally with the base member.

To implement the idea of stabilizing the field emission current of a field emission device by connecting a field effect transistor in series therewith, this invention incorporates the FET in the emitter itself. Since the incorporation of the FET does not add to the size of the device, the field emission device can be held to approximately the same size as one not incorporating a FET and is not degraded in packing density. Further, the incorporation of the FET structure in the emitter by the same process as that for fabricating the emitter, not by a separate process, results in high fabrication efficiency and improved product yield.

DESCRIPTION OF THE PREFERRED EMBODIMENTS

Figure 1:
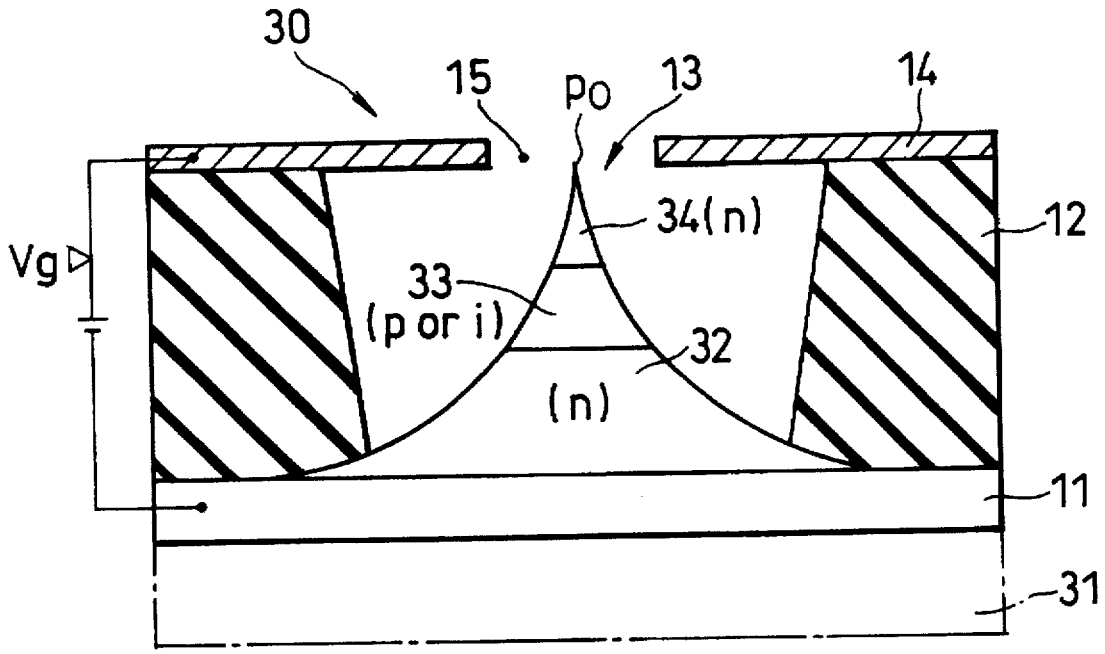
FIG. 1 is a sectional schematic view showing the structure of a field emission device that is a basic embodiment of the invention.
Figure 6A:
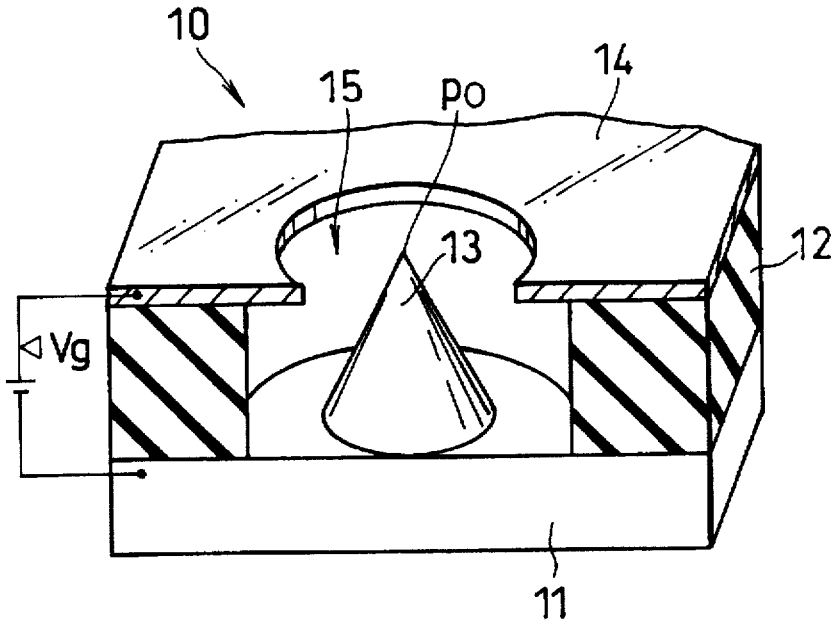
FIG.6(A) (PRIOR ART)
FIG. 6(A) is a perspective schematic view showing a typical example of a prior-art field emission device.
Figure 6B:
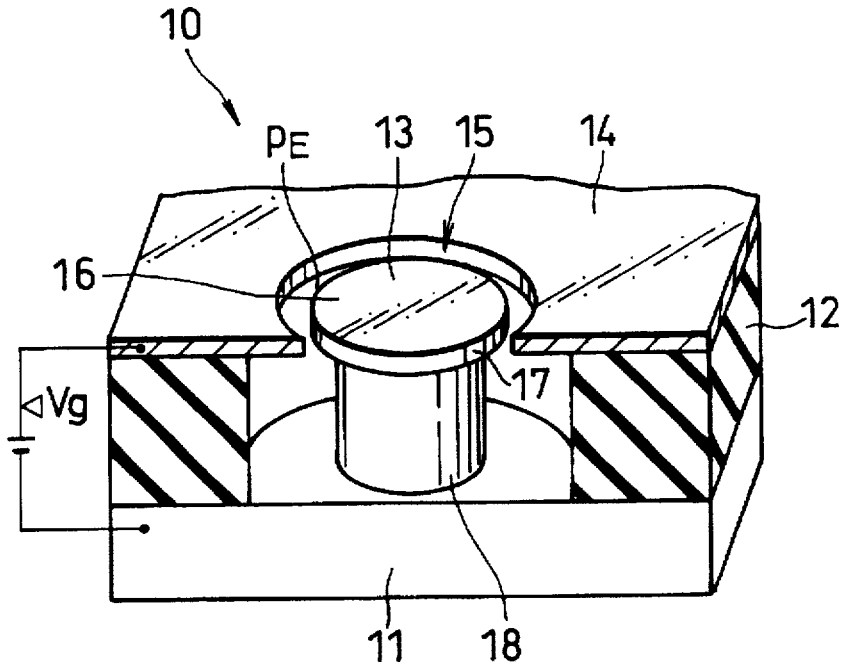
FIG.6(B) (PRIOR ART)
FIG. 6(B) is a perspective schematic view showing another example of a prior-art field emission device.
Figure 7A:
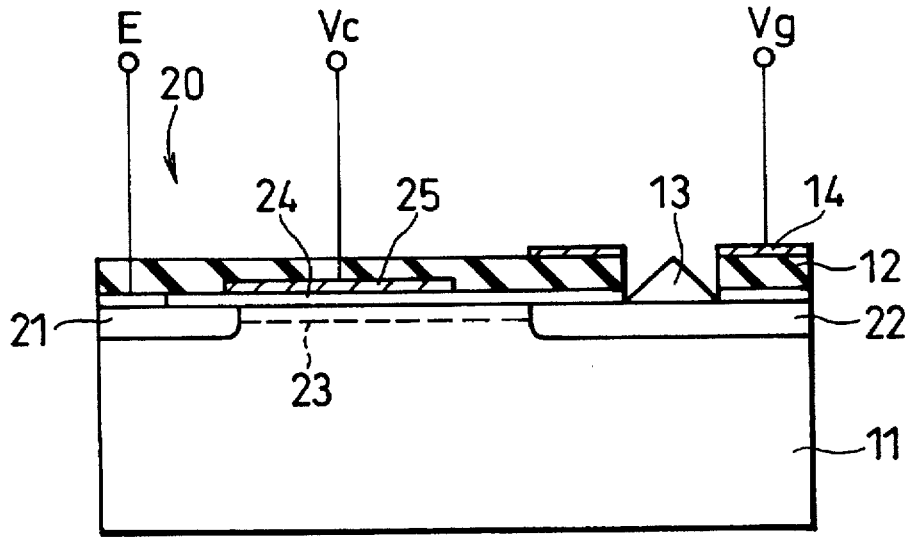
FIG.7(A) (PRIOR ART)
FIG. 7(A) is a schematic view showing a prior-art field emission device structure for stabilizing field emission current.
Figure 7B:
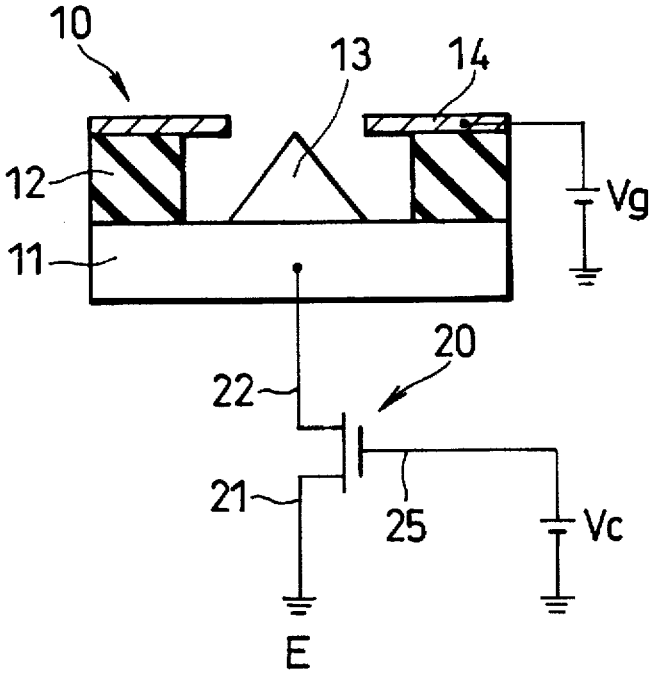
FIG.7(B) (PRIOR ART)
FIG. 7(B) is a diagram for explaining the principle of the device of FIG. 7(A).

FIG. 1 schematically illustrates the essential structural elements of a field emission device 30 according to this invention. As pointed out earlier, this type of field emission device is ordinarily required to be fabricated in large numbers at high packing density. Since this invention is applicable to such devices as individual units, however, the embodiments that follow are each described and illustrated in terms of a unit element. In addition, structural elements which correspond to or can be the same as those of the prior-art field emission device 10 explained in the foregoing with reference to FIGS. 6 and 7 are assigned the same reference symbols as those of the field emission device 10.

The invention field emission device 30 shown in FIG. 1 comprises a base member 11 which can consist of a bulk semiconductor substrate per se or, as indicated by the chain line in the figure, a semiconductor layer or a conductive layer formed on an insulating substrate 31 of glass or the like. The base member 11 serves as a physical support member for the device. An insulating layer 12 is formed on the base member 11 and a gate 14, which can be the same conductive electrode layer as shown in FIG. 6, is formed on the insulating layer 12. Specifically, the gate 14 is formed with an aperture 15, a recess is formed under the aperture 15, and an emitter 13 is provided in the recess. In this embodiment, the emitter 13 is a three-dimensional structure in the shape of a cone (either circular or polygonal). The conical emitter 13 rests on the base member 11 with the base thereof in physical and electrical contact with the base member 11. The distal (free) end of the emitter 13 (in this embodiment, the tip $P_O$ of the cone including the apex) faces into the aperture 15 of the gate 14.

The structure described up to this point is not particularly different from that described earlier regarding FIG. 6. The difference that is the feature of this invention is found inside the emitter 13. Specifically, the emitter 13 is provided at its base side in contact with the base member 11 with a source region layer 32 constituted of n-type semiconductor, at its tip $P_O$ side with a drain region layer 34 constituted of n-type semiconductor, and at the region between the source region layer 32 and the drain region layer 34 with a channel region layer 33 adapted to have a channel selectively induced at the surface thereof.

The channel region layer 33 is ordinarily formed of semiconductor of the opposite conductivity type from that of the source and drain region layers 32, 34, namely of p-type semiconductor. Even when the field emission device 30 is normally operated in a room temperature environment, however, the channel region layer 33 can, in the case where the stacked structure of the layers 32, 33, 34 in the emitter 13 operate as a FET structure, be formed of i-type semiconductor. This is because even in the case of i-type semiconductor the energy band structure required for FET operation can be treated in the same manner as in the case of using p-type semiconductor. Ordinary FETs generally have to exhibit clearly defined OFF and ON states. When i-type semiconductor is used, the fact that the channel region is a surface region of the substrate makes it impossible to secure insulation with respect to the source region and drain region, so that it becomes necessary to ensure insulation by reverse biasing with respect to the source region and drain region. As regards its use in this invention, however, since in principle there is no need to directly adjust the channel region layer 33 to any specific external potential and the focus is on controlling the amount of field emission current by varying the conductivity of the channel, use of i-type semiconductor entails no particular disadvantage. This does not mean that the device 30 is limited to use in a room temperature environment but that it can be used in a room temperature environment even if i-type semiconductor is utilized. Even when the device is used in a low temperature environment, particularly in a very low temperature environment at which carrier freeze-out a channel can be induced in the surface of the channel region layer 33 of either p-type or i-type semiconductor, thereby ensuring at least active carrier flow and thus that the device can be used in such an environment. The foregoing points also apply to the other embodiments of the invention described later.

It should be noted, however, that in the field emission device structure of FIG. 1 the gate 14 for extracting electrons from the distal end, particularly the tip $P_O$, of the emitter 13 under application of a strong electric field must be positioned so that the electric field also acts on the channel region layer 33 to enable a channel (inversion layer) to be induced in the surface of the channel region layer 33 and the conductivity to be varied. In other words, the channel region layer 33 is located at a position where it is acted on by the electric field produced by application of the gate voltage Vg to the gate 14.

In this structure, the flow of field emission current from the tip $P_O$ of the emitter 13 is determined primarily by the strength of the electric field applied to the tip $P_O$ and thus to the magnitude of the gate voltage Vg applied to the gate 14. The field emission current increases exponentially with increasing magnitude of the gate voltage Vg. On the other hand, the amount of current supplied to the tip $P_O$ of the emitter 13 is determined by the amount of current flowing through the channel region layer 33 built into the emitter 13, which current is fundamentally a function of the product of the electron density and the electron mobility of the channel (inversion layer) induced in the channel region layer 33. Insofar as the electric field generated by the gate 14 is able to act on the channel region layer 33, the electron concentration and thus the amount of current passage are determined fundamentally as linear functions of the gate voltage Vg applied to the gate 14.

In other words, in the invention field emission device 30 shown in FIG. 1, the gate 14 not only operates as an extractor gate as in the conventional field emission device but also functions as a gate for controlling the amount of current passage (actual amount of field emission current from the emitter).

Thus this invention is based on ingenious utilization of two physical characteristics, one being that the amount of field emission current from the emitter 13 increases rapidly (exponentially) in proportion to increase in the gate voltage Vg and the other being that the actual amount of field emission current equal to the amount of current passing through the channel region layer 33 of the FET structure inside the emitter increases linearly in proportion to increase in the gate voltage Vg. Therefore, since the operating principle is such that the amount of current passage through the channel region layer 33 of the FET structure can be significantly smaller than the amount field emission current, the amount of field emission current from the emitter 13 is restricted and stabilized by the amount of current passage through the channel.

While setting the stabilization point involves design considerations, it is not simply a matter deciding the gate voltage Vg but also involves such parameters as the distance between the gate 14 and the channel region layer 33, the thickness and resistivity (conductivity) of the channel region layer 33 and the like. When the source region layer 32 and the drain region layer 34 are formed of n-type semiconductor and the channel region layer 33 is formed of p-type semiconductor, as described in the foregoing, high-concentration n-type semiconductor is preferably used for the source and drain regions 32, 34 so that they have resistivities on the order of 0.01 Ωcm (have high conductivity) and low-concentration p-type semiconductor is preferably used for the channel region layer 33 so that it has a resistivity of not less than 1 Ωcm (has low conductivity). In special cases, however, it is possible to form a thin n-type channel beforehand by using ion implantation or other such technology to introduce impurity into the surface portion of a channel region layer 33 constituted as a p-type or i-type semiconductor layer. Since this also enables the conductivity of the channel region layer 33 to be controlled to vary with increase in the electric field applied to the channel region layer 33, no change arises in the ability to control the amount of field emission current as a linear function of the applied electric field. This point also applies to the other embodiments of the invention described later.

Figure 2:
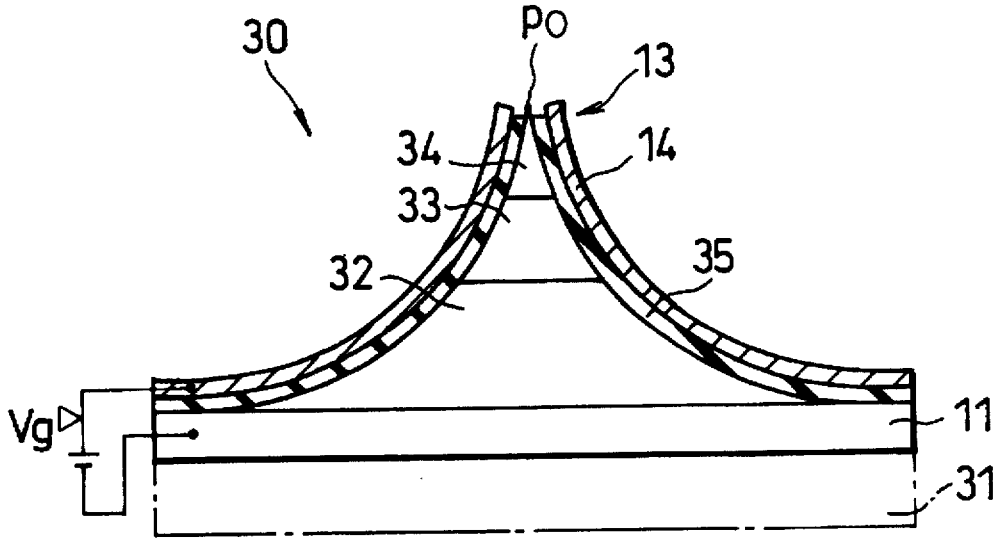
FIG. 2 is a sectional schematic view showing the structure of a field emission device that is a second embodiment of the invention.

FIG. 2 show a second embodiment of the invention. Reference symbols which are the same as those in FIG. 1 designate identical or corresponding structural elements. This embodiment is improved in respect of the gate 14. The surface of the emitter 13 is formed with an insulating layer 35 and a gate 14 is formed on the insulating layer 35 as a thin conductive electrode layer. As a result, the surface portion of the channel region layer 33 is in very close proximity to a gate like that of the ordinary FET structure, as separated therefrom by a gate insulating layer like that of an ordinary FET structure, whereby efficient and precise field effect control of the amount of channel current passage can be achieved. On the other hand, since the tip PO of the emitter 13 is exposed and the upper end of the gate 14 is located very close thereto, the gate voltage required for stimulating field emission is low. A method of fabricating a field emission device 30 of this structure will now be explained with reference to FIG. 3.

Figure 3A:
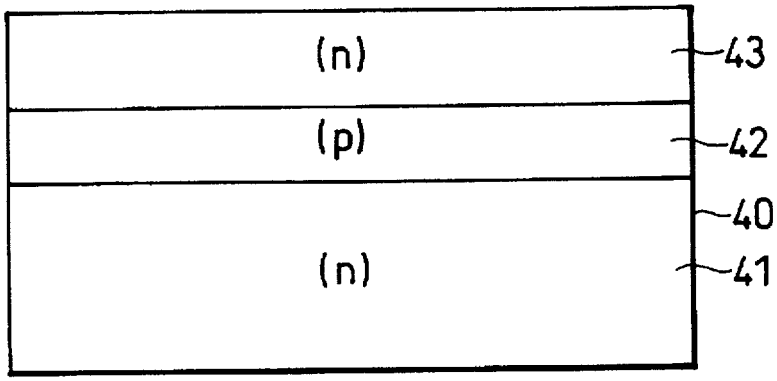
FIG. 3(A)–3(C) are a diagram showing steps in a process for fabricating a structure conforming to that of the field emission device shown in FIG. 2.

As shown in FIG. 3(A), an n-type silicon substrate 40 is formed in the thickness direction with a p-type semiconductor layer 42 and an n-type semiconductor layer 43, while leaving the major portion thereof as an n-type semiconductor layer 41. This can be achieved by known ion implantation or epitaxial growth methods. The semiconductor layers 42, 43, which are destined to become the channel region layer 33 and the drain region layer 34, are formed to no more than several microns in thickness and generally to submicron order thickness. The remaining n-type semiconductor layer 41 accounting for almost all of the thickness of the n-type silicon substrate 40 becomes the source region layer 32 and the base member 11 integral therewith.

Figure 3B:
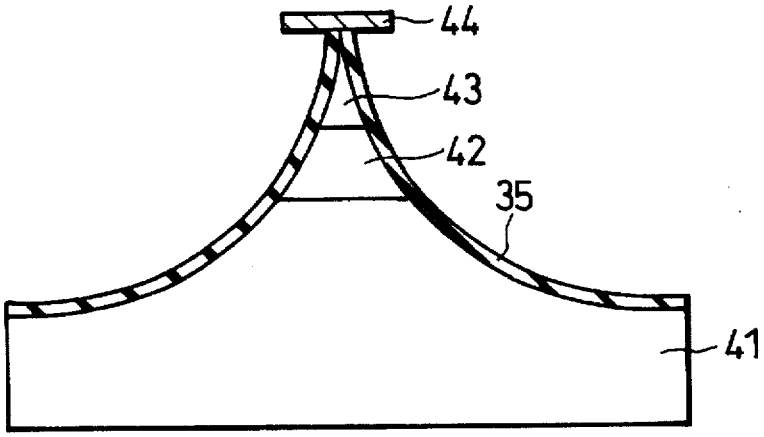

Next, as shown in FIG. 3(B), a $SiO_2$ mask 44 of appropriate size is formed and a known plasma etching method is used to form the conical emitter 13. The result is subjected to thermal oxidization with the mask 44 left in place, thereby forming the insulating layer 35 on the emitter 13 as a thermally oxidized layer.

Figure 3C:
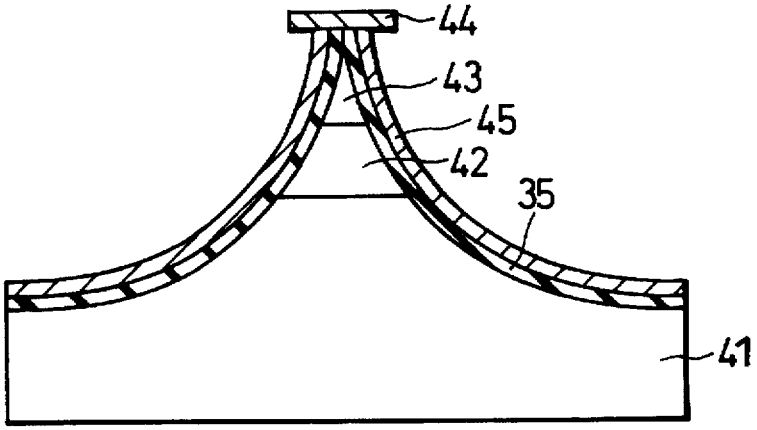

Next, an appropriate conductive material layer 45 (to become the gate 14) of tungsten or other appropriate metal, an alloy of silicon and metal, polycrystalline silicon or the like is formed to a prescribed thickness as shown in FIG. 3(C) using a strongly isotropic sputtering method or other such thin film deposition technique, whereafter the whole structure is immersed in a buffered hydrofluoric acid solution to remove the mask 44 and part of the insulating layer 35. The resulting structure, which is the same as that of FIG. 2 except that the base member 11 and the source region layer 32 of the emitter 13 are formed integrally, constitutes a field emission device 30 according to the invention.

Figure 4:
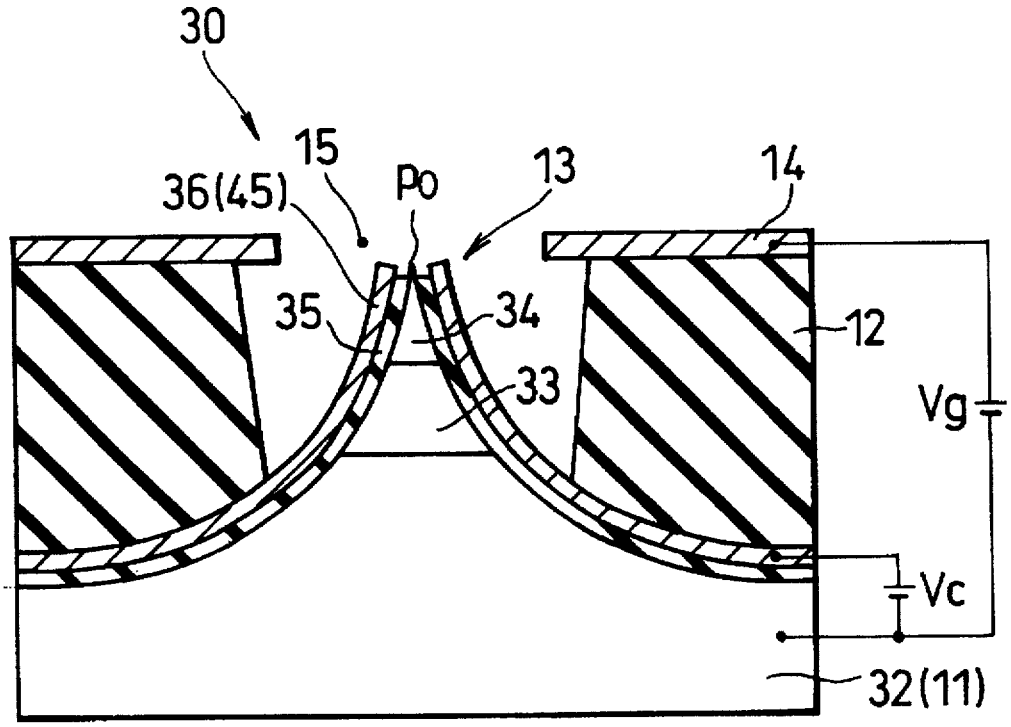
FIG. 4 is a sectional schematic view showing the structure of a field emission device that is another embodiment of the invention.

That the base member 11 and the source region layer 32 of the emitter 13 can be integral with each other and can be so obtained and, further, that the source region layer 32 formed on the base side of the emitter 13 can be the base member 11 itself is also true of the embodiment shown in FIG. 1 as well as of the embodiment described later with reference to FIG. 4. Therefore, integration of the source region layer 32 with the base member 11 can eliminate a separate step of the formation of a source region and simplify a device fabrication process.

Obviously, forming the thin film deposit by use of a method with strong an isotropy such as the vacuum deposition method would also make it possible to fabricate the embodiment of FIG. 1 by the same method. The semiconductor material is of course not limited to the aforesaid single crystal silicon but can instead be amorphous silicon or polycrystalline silicon. Germanium, gallium arsenide and other such materials can also be used. In all cases the structures shown in FIGS. 1 and 2 and that described later with reference to FIG. 4 can be obtained using existing processing technologies.

In the embodiments described in the foregoing the single gate 14 serves both as the extractor gate and as the gate of a FET structure for controlling and stabilizing field emission current. Differently from this, another embodiment of the invention shown in FIG. 4 establishes the two gates independently. Specifically, the surface of the emitter 13 formed on the base member 11 is, in the manner of the embodiments shown in FIGS. 2 and 3, formed with an insulating layer 35 and on the insulating layer 35 with a conductive material layer 45 constituting an electric field control gate (second gate) 36 of the FET structure incorporated in the emitter 13. In addition, a gate 14 for extracting electrons from the emitter 13 is provided on top of an insulating layer 12 formed on the base member 11, in the manner of the device structure shown in FIG. 1. This structure makes it possible to independently set and vary the gate voltage Vg for generating the electric field required for electron extraction and the control voltage Vc for generating the electric field for controlling the conductivity of the FET structure comprising the source region layer 32, channel region layer 33 and drain region layer 34 built into the emitter 13 (i.e. for controlling the amount of current passage through the channel region layer 33). The field emission device 30 of this structure exhibits enhanced versatility and enables more precise control of field emission current during actual operation.

When the illustrated structure is adopted, moreover, the second gate 36 can also contribute to generation of the electric field for field emission. Thus, differently from the ordinary case of using only a single extractor gate 14, wherein the actual voltage applied to the gate is required to be several tens of volts or more even when the device is fabricated to extremely small dimensions as observed in conventional field emission devices, in the case of the device structure shown in FIG. 4 application to the extractor gate 14 of a voltage smaller than that conventionally used followed by application of a voltage of only several volts to the second gate 36 makes it possible to control not only the amount of field emission current from the emitter 13 but also the ON/OFF state thereof.

The ability to control the amount of field emission current or to turn it on and off at low voltage in this manner is particularly advantageous in the case where a large number of field emission devices 30 of this type are integrated in a two-dimensional array for use in an FPD or the like as mentioned at the beginning of this specification.

If, differently from the foregoing, it is desired to enable use of the second gate 36 primarily for selectively generating an electric field solely with respect to the FET structure incorporated in the emitter 13, this can be achieved by defining the position of the second gate 36 and the position of the channel region layer 33 to be as far away from the electron emitting portion of the emitter 13 (the tip PO in the illustrated case) as possible. Similarly, to minimize the effect of the electric field generated by the extractor gate 14 on the channel region layer 33, it suffices to make the distance between the second gate 36 and the channel region layer 33 much shorter than the distance between the extractor gate 14 and the channel region layer 33. The structure for providing the second gate 36 for controlling the amount of current passage of the emitter (FET structure) separately and independently of the extractor gate 14 is of course not limited to that shown in FIG. 4. For example, a plate-shaped second gate 36 can be provided parallel to the extractor gate 14 near the channel region layer 33.

Figure 5A:
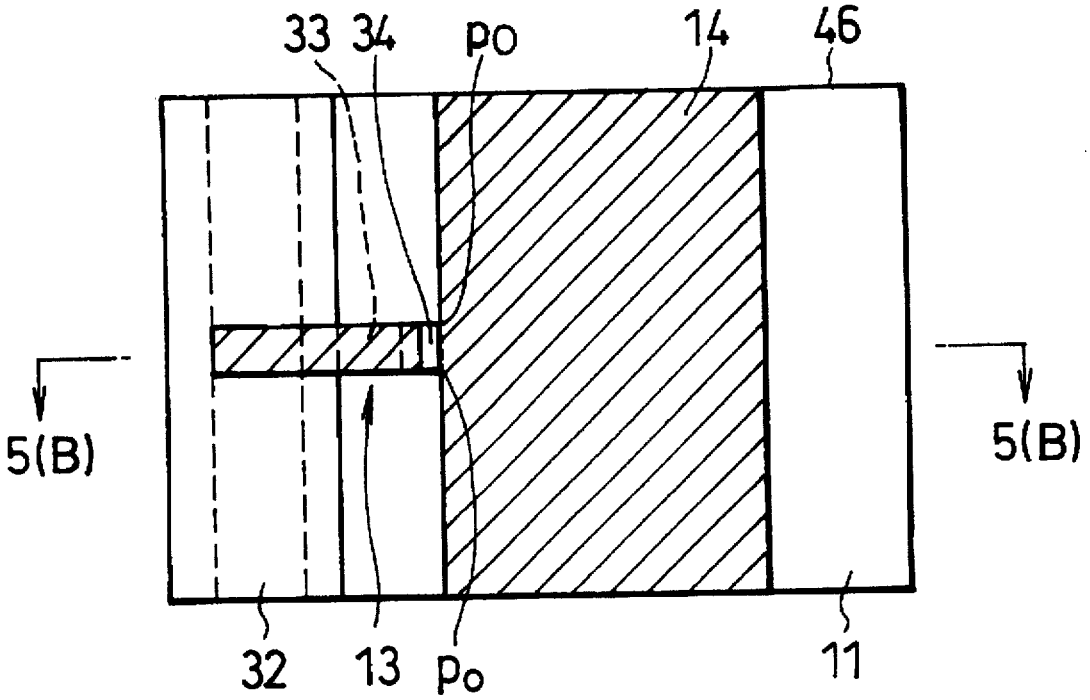
FIG. 5(A) is a schematic view showing the structure of a field emission device that is another embodiment of the invention.
Figure 5B:
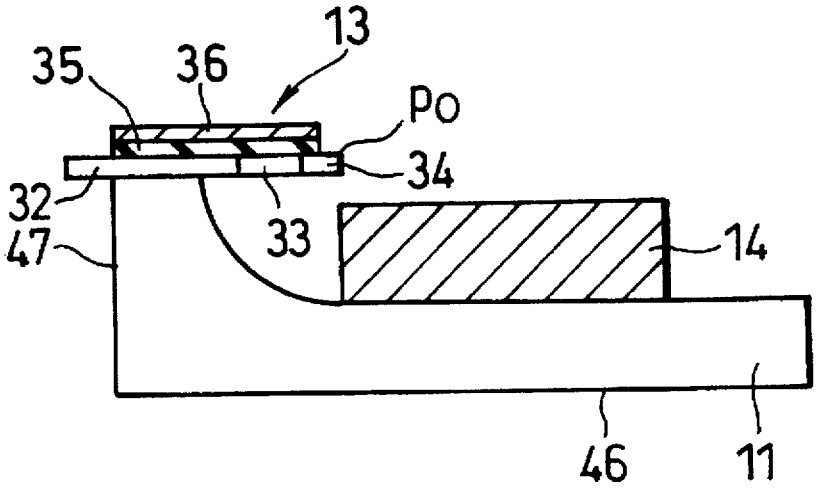
FIG. 5(B) is a sectional view taken along line 5(B)—5(B) of FIG. 5(A).

FIGS. 5(A) and 5(B) show another embodiment of the invention applied to a planar field emission device, wherein FIG. 5(A) is a plan view of the device and FIG. 5(B) a sectional view of the same. In this case the base member 11 is an insulating substrate having a flat surface portion 46 a protruding portion 47 protruding from the flat surface portion 46. The n-type semiconductor source region layer 32 constituting the base of the emitter 13 is supported by and fixed to the protruding portion 47 of the base member 11 and, as shown in FIG. 5(A), has a path-like configuration of some width owing to the fact that it also serves as a wiring layer to the emitter itself. The p-type or i-type semiconductor channel region layer 33 connected with the base and source region layer 32, the n-type semiconductor drain region layer 34 constituted at the tip and, in combination therewith, the source region layer 32 form the emitter 13 as a plate-shaped member extending parallel or nearly parallel to the flat surface portion 46 of the base member 11. These members are overlaid with an insulating layer 35 corresponding to the gate insulating layer of an ordinary FET structure and the aforesaid second gate 36 constituting the gate of the FET structure is formed on the insulating layer 35 as a conductive electrode layer. The tip of the emitter 13, particularly the two corners $P_O$, $P_O$ of its rectangular configuration in this case, become the main electron emission locations and since the electric field concentrates here, the extractor gate 14 is formed on the flat surface portion 46 of the base member 11 at a position near the corners $P_O$, $P_O$.

In the field emission device 30 of this structure, the strong electric field produced by the voltage applied to the extractor gate 14 extracts electrons mainly from the tip corners $P_O$, $P_O$ of the rectangular emitter 13 in a direction parallel or nearly parallel to the flat surface portion of the base member 11, while the electric field produced by the voltage applied to the second gate 36 controls the amount of current passage of the channel region layer 33 of the FET structure incorporated in the emitter 13, whereby the actual amount of field emission current emitted from the emitter is controlled.

In this embodiment, the material of the emitter 13 can again be selected from various types of semiconductors. On the other hand, the base member 11 need not have insulating property throughout and it suffices if at least the portion formed with the gate 14 is insulating. The remaining portions can be formed of semiconductor or other conductive material. The structure of FIG. 5 can also be fabricated from a commercially available substrate produced using SOI (silicon-on-insulator) technology, namely a substrate obtained by forming a thin film of single crystal silicon on a 1–2 μm-thick film of $SiO_2$ on a substrate of single crystal silicon.

In addition, the structure of the planar field emission device shown in FIG. 5 can be also be modified to use only a single gate 14. Even if the second gate 36 is omitted, the operation explained with reference to FIGS. 1 and 2 can be obtained provided that the extractor gate 14 is provided at a location where the field effect thereof can act on the channel region layer 33.

As is clear from the embodiments explained in the foregoing, the main point of the invention is that the source, channel and drain of a FET are incorporated in the emitter 13 (it being understood that the source can also serve as the base member). The emitter itself can therefore have any of various external configurations including those shown in FIGS. 6(A), 6(B) and those of various other prior art field emission devices, while the shape and location of the extractor gate can be selected with reference to the prior art to configure field emission devices other than those illustrated in the drawings. The principle of the invention can also be applied for incorporating a FET structure in the so-called "multiemitter" having multiple electron emission points.

What is claimed is:

1. A field emission device having a three-dimensional emitter rising from a base fixed on a base member serving as a support member and adapted to emit cold electrons from an electric field concentration formed at a distal end thereof under application of an electric field produced by applying a voltage to an extractor gate provided near the distal end, the field emission device comprising:

an n-type semiconductor source layer provided on the base side of the emitter;

an n-type semiconductor drain layer provided on the distal end side of the emitter; and a channel region layer provided between the source layer and the drain layer for controlling an amount of current passage in dependence on the magnitude of the applied electric field;

wherein:

said electric field concentration comprises one of an electric field concentration tip and an electric field concentration edge; and said electric field, generated by application of said voltage to the extractor gate in proportion to the voltage applied thereto, also being applied to the channel region layer for controlling the amount of current passage.

2. A field emission device according to claim 1, wherein:

the extractor gate is a conductive electrode layer formed on an insulating layer formed on a surface of the base member, and the emitter is disposed to have its distal end facing into an aperture formed in the conductive electrode layer.

3. A field emission device according to claim 2, wherein:

the three-dimensional emitter has a conical shape rising from the base to a pointed distal end and is adapted to emit the cold electrons from an apex region of the cone.

4. A field emission device according to claim 3, wherein:

the extractor gate is constituted as a conductive electrode layer formed along a surface of the conical emitter as separated therefrom by an insulating layer.

5. A field emission device according to claim 1, wherein:

the base member is made of n-type semiconductor, and the source layer of the emitter is integral with the base member.

6. A field emission device according to claim 1, wherein:

the base member has a flat surface portion and a protruding portion protruding from the flat surface portion for fixing the base of the emitter thereon, the three-dimensional emitter has the shape of a plate extending from its base fixed on the protruding portion of the base member toward its distal end in a direction parallel or nearly in parallel with the flat surface portion of the base member, and the cold electrons are emitted mainly from corners of the plate at the distal end of the emitter.

7. A field emission device according to claim 6, wherein:

the base member has insulating property, and the extractor gate is provided directly on the flat surface portion of the base member.

8. A field emission device having a three-dimensional emitter rising from a base fixed on a base member serving as a support member and adapted to emit cold electrons from an electric field concentration formed at a distal end thereof under application of an electric field produced by applying a voltage to an extractor gate provided near the distal end, the field emission device comprising:

an n-type semiconductor source layer provided on the base side of the emitter;

an n-type semiconductor drain layer provided on the distal end side of the emitter;

a channel region layer provided between the source layer and the drain layer for controlling an amount of current passage in dependence on the magnitude of the applied electric field; and a second gate provided separately of the extractor gate, an electric field generated by the second gate in proportion to a voltage applied thereto being applied to the channel region layer for controlling the amount of current passage in the channel region layer;

wherein:

said electric field concentration comprises one of an electric field concentration tip and an electric field concentration edge.

9. A field emission device according to claim 8, wherein:

the second gate is provided closer to the channel region layer than is the extractor gate.

10. A field emission device according to claim 8, wherein:

the electric field generated by the voltage applied to the second gate acts on the distal end of the emitter and contributes to the emission of cold electrons.

11. A field emission device according to claim 8, wherein:

the extractor gate is a conductive electrode layer formed on an insulating layer formed on a surface of the base member, and the emitter is disposed to have its distal end facing into an aperture formed in the conductive electrode layer.

12. A field emission device according to claim 11, wherein:

the three-dimensional emitter has a conical shape rising from the base to a pointed distal end and is adapted to emit the cold electrons from an apex region of the cone.

13. A field emission device according to claim 12, wherein:

the second gate is constituted as a conductive electrode layer formed along a surface of the conical emitter as separated therefrom by an insulating layer.

14. A field emission device according to claim 8, wherein:

the base member is made of n-type semiconductor, and the source layer of the emitter is integral with the base member.

15. A field emission device according to claim 8, wherein:

the base member has a flat surface portion and a protruding portion protruding from the flat surface portion for fixing the base of the emitter thereon, the three-dimensional emitter has the shape of a plate extending from its base fixed on the protruding portion of the base member toward its distal end in a direction parallel or nearly in parallel with the flat surface portion of the base member, and the cold electrons are emitted mainly from corners of the plate at the distal end of the emitter.

16. A field emission device according to claim 15, wherein:

the base member has insulating property, and the extractor gate is provided directly on the flat surface portion of the base member.

17. A field emission device according to claim 16, wherein:

the second gate is formed on an insulating layer formed on the surface of the plate-shaped emitter.

* * * * *